US007624841B2

(12) United States Patent
Bae et al.

(10) Patent No.: US 7,624,841 B2
(45) Date of Patent: Dec. 1, 2009

(54) SILENCER

(75) Inventors: Seong Won Bae, Seoul (KR); Deok Huh, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 269 days.

(21) Appl. No.: 11/702,678

(22) Filed: Feb. 6, 2007

(65) Prior Publication Data

US 2007/0205044 A1 Sep. 6, 2007

(30) Foreign Application Priority Data

Feb. 7, 2006 (KR) ..... 10-2006-0011638

(51) Int. Cl.
*F01N 1/02* (2006.01)
*F01N 1/08* (2006.01)
*F01N 1/00* (2006.01)

(52) U.S. Cl. ..... 181/249; 181/255; 60/322

(58) Field of Classification Search ..... 181/249, 181/248, 247, 255, 250; 60/312, 322
See application file for complete search history.

(56) References Cited

U.S. PATENT DOCUMENTS 1,878,424 A * 9/1932 Oldberg ..... 181/250
1,975,861 A * 10/1934 Oldberg ..... 181/250
2,101,460 A * 12/1937 Schmidt ..... 181/252
2,213,614 A * 9/1940 Scarritt ..... 181/255
2,562,101 A * 7/1951 Hoyle ..... 181/255
3,754,619 A * 8/1973 McCormick ..... 181/248
4,371,053 A * 2/1983 Jones ..... 181/249
4,371,054 A * 2/1983 Wirt ..... 181/252
4,993,513 A * 2/1991 Inoue et al. ..... 181/282
5,677,518 A * 10/1997 Fischer et al. ..... 181/255
5,955,707 A * 9/1999 Fritz ..... 181/282
6,260,659 B1 * 7/2001 Takahashi et al. ..... 181/255
6,283,246 B1 * 9/2001 Nishikawa ..... 181/255
6,341,663 B1 * 1/2002 Alex et al. ..... 181/249
7,331,422 B2 * 2/2008 Wall ..... 181/279
2002/0153197 A1 * 10/2002 Cummings et al. ..... 181/249
2005/0126850 A1 * 6/2005 Yamaguchi et al. ..... 181/249
2007/0158135 A1 * 7/2007 Shimomura ..... 181/249
2007/0158136 A1 * 7/2007 Shimomura et al. ..... 181/249
2007/0227809 A1 * 10/2007 Sakurai et al. ..... 181/249

* cited by examiner

*Primary Examiner*—Edgardo San Martin
(74) *Attorney, Agent, or Firm*—Ked & Associates LLP

(57) ABSTRACT

A silencer having improved noise reduction characteristics is disclosed. The silencer includes a first cylindrical connection pipe for guiding the flow of a fluid, a cylindrical expansion pipe communicating with the first connection pipe at one end thereof for guiding the flow of the fluid, the expansion pipe having a sectional area greater than that of the first connection pipe, and a second cylindrical connection pipe communicating with the other end of the expansion pipe for guiding the flow of the fluid. The expansion pipe has a length (L) decided depending upon a diameter (D) of the first connection pipe or the second connection pipe. According to the present invention, resonance caused by a pipe connected to the silencer is prevented, and therefore, the noise reduction efficiency of the silencer is improved.

31 Claims, 4 Drawing Sheets

SILENCER

CROSS-REFERENCE TO RELATED APPLICATION

This application claims the benefit of Korean Patent Application No. 10-2006-0011638, filed on Feb. 7, 2006, which is hereby incorporated by reference in its entirety as if fully set forth herein.

BACKGROUND OF THE INVENTION

1. Field of the Invention

The present invention relates to a silencer, and more particularly, to a silencer wherein the diameter and the length of a pipe are adjusted to improve noise reduction characteristics of the silencer.

2. Discussion of the Related Art

Generally, a silencer is an apparatus for reducing noise generated from an internal-combustion engine or ventilation equipment. Based on its operating principle, the silencer may be classified as an expansion type silencer constructed in a structure in which noise is diffused from a small-diameter pipe to a large-diameter pipe so as to reduce the noise, a resonance type silencer constructed in a structure in which noise is diffused from a small-diameter pipe to a wide resonance chamber through a plurality of holes formed in the small-diameter pipe so as to offset the noise, or an absorption type silencer constructed in a structure in which the silencer is provided with a noise-absorbing material, by which noise is absorbed, and therefore, the noise is reduced.

The structure and the operating principle of a conventional expansion type silencer will be described with reference to FIG. 1.

The conventional expansion type silencer includes a first cylindrical connection pipe 10, an cylindrical expansion pipe 50 communicating with the first connection pipe 10 at one end thereof, the expansion pipe 50 having a sectional area greater than that of the first connection pipe 10, and a second cylindrical connection pipe 30 communicating with the other end of the expansion pipe 50.

The noise reduction efficiency of the silencer may be represented by various values. Typically, noise reduction efficiency of the silencer may be represented by transmission loss (TL) which algebraically expresses the ratio of input sound pressure level to transmission sound pressure level when a fluid is transmitted through the silencer.

When the first connection pipe 10 and the second connection pipe 30 have the same sectional area, the transmission loss (TL) of the expansion type silencer as shown in FIG. 1 may be represented by the following equation:

$$TL = 10\log\left(1 + \frac{1}{4}\left(m - \frac{1}{m}\right)^2 \sin^2 kL\right) \quad \text{[Equation 1]}$$

Where, m is the ratio in sectional area of the first connection pipe to the expansion pipe, k is wave number, and L is the length of the expansion pipe.

On the other hand, the connection regions between the expansion pipe 50 and the first and second connection pipes are generally designed such that the sectional area of the connection regions is not abruptly changed, i.e., gradually changed, so as to minimize flow resistance. When the shape of the connection regions is changed, the acoustic characteristics of the silencer are also changed. Strictly speaking, the symbol L in the above equation is not the actually measured length of the expansion pipe 50 but the length acoustically converted by adding and subtracting the actually measured length of the expansion pipe 50.

Specifically, the symbol L in Equation 1 means the acoustic length corrected from the actually measured length according to the concretely applied shape of the expansion pipe 50. Here, a method of calculating the acoustic length is well known to those skilled in the art to which the present invention pertains, and therefore, a detailed description thereof will not be given.

As shown in FIG. 1, not the distance between opposite ends of the actual expansion pipe 50 but the distance between points extending from the opposite ends of the expansion pipe 50 to specific positions of the respective connection regions is indicated by L.

In Equation 1, TL is maximized when $\sin^2 kL$ is 1. Consequently, the transmission loss (TL) is maximized when the following condition is satisfied:

$$kL = \frac{n\pi}{2},\ n = 1, 3, 5, \ldots \quad \text{[Equation 2]}$$

In the above equation, the relation of $$k = \frac{2\pi}{\lambda}$$

$\lambda$ is the wavelength of an input sound source) is satisfied, and therefore, the above equation may be expressed by the following equation:

$$L = \frac{\lambda}{4}n,\ n = 1, 3, 5, \ldots \quad \text{[Equation 3]}$$

As can be seen from the above equation, the transmission loss (TL) of the silencer is maximized when the length of the expansion pipe 50 is odd multiples of $\lambda/4$.

Consequently, when designing the silencer, the wavelength $\lambda$ at a target frequency band is calculated such that the maximum noise reduction efficiency can be exhibited at the target frequency band in a specific operation condition, and the length L of the expansion pipe 50 is decided based on Equation 3.

However, the conventional silencer with the above-stated construction has a problem in that the target frequency band noise cut off as a fluid passes through the silencer is reincreased due to a resonance mode of a pipe connected to the silencer.

In addition, the conventional silencer has a problem in that, when an additional silencing unit is mounted in the silencer, the dimensions of the expansion pipe designed according to the target frequency band become insignificant.

SUMMARY OF THE INVENTION

Accordingly, the present invention is directed to a silencer that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a silencer includes a first cylindrical connection pipe for guiding the flow of a fluid, a cylindrical expansion pipe communicating with the first connection pipe at one end thereof for guiding the flow of the fluid, the expansion pipe having a sectional area greater than that of the first connection pipe, and a second cylindrical connection pipe communicating with the other end of the expansion pipe for guiding the flow of the fluid, the expansion pipe having a length (L) decided depending upon a diameter (D) of the first connection pipe or the second connection pipe.

Preferably, the diameter (D) of the first connection pipe or the second connection pipe and the length (L) of the expansion pipe satisfy the following equation:

$$L = \frac{n}{4m+2}D$$

Where, m and n are arbitrary odd numbers.

Preferably, the diameter (D) of the first connection pipe or the second connection pipe and the length (L) of the expansion pipe satisfy the following equation:

$$L = \left(l - \frac{1}{2}\right)D$$

Where, l is an arbitrary positive number.

The silencer may further include a silencing unit mounted in the expansion pipe for removing noise.

In another aspect of the present invention, a silencer includes a first cylindrical connection pipe for guiding the flow of a fluid, a cylindrical expansion pipe communicating with the first connection pipe at one end thereof for guiding the flow of the fluid, the expansion pipe having a sectional area greater than that of the first connection pipe, a second cylindrical connection pipe communicating with the other end of the expansion pipe for guiding the flow of the fluid, and at least one silencing unit mounted in the expansion pipe for removing noise from the expansion pipe, at least one length (L) of an opposite-end length between the first connection pipe and the at least one silencing unit and an opposite-end length between the at least one silencing unit and the second connection pipe being decided depending upon a diameter (D) of the first connection pipe or the second connection pipe.

Preferably, the at least one length (L) of the opposite-end length between the first connection pipe and the at least one silencing unit and the opposite-end length between the at least one silencing unit and the second connection pipe satisfy the following equation:

$$L = \frac{n}{4m+2}D$$

Where, m and n are arbitrary odd numbers.

Preferably, the diameter (D) of the first connection pipe or the second connection pipe and the at least one length (L) of the opposite-end length between the first connection pipe and the at least one silencing unit and the opposite-end length between the at least one silencing unit and the second connection pipe satisfy the following equation:

$$L = \left(l - \frac{1}{2}\right)D$$

Where, l is an arbitrary positive number.

Preferably, the at least one silencing unit is a resonance type silencing unit which removes specific frequency noise using resonance.

Preferably, the resonance type silencing unit includes a perforation part extending in the circumferential direction while being spaced a predetermined distance from the expansion pipe, the perforation part having one or more through-holes, a resonance part having a predetermined space defined between an inner wall of the expansion pipe and the perforation part, and sidewall parts disposed at opposite ends of the perforation part, respectively, the sidewall parts being connected to the expansion pipe such that the resonance part constitutes a closed space.

Preferably, the at least one silencing unit includes a plurality of silencing units mounted in the expansion pipe such that the silencing units are spaced a predetermined distance from each other, and the diameter (D) of the first connection pipe or the second connection pipe and a distance (L) between the respective silencing units satisfy the following equation:

$$L = \frac{n}{4m+2}D$$

Where, m and n are arbitrary odd numbers.

Preferably, the diameter (D) of the first connection pipe or the second connection pipe and the distance (L) between the respective silencing units satisfy the following equation:

$$L = \left(l - \frac{1}{2}\right)D$$

Where, l is an arbitrary positive number.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First, the fundamental structure of a silencer according to a first embodiment of the present invention will be described in detail with reference to FIG. 2.

Figure 1:
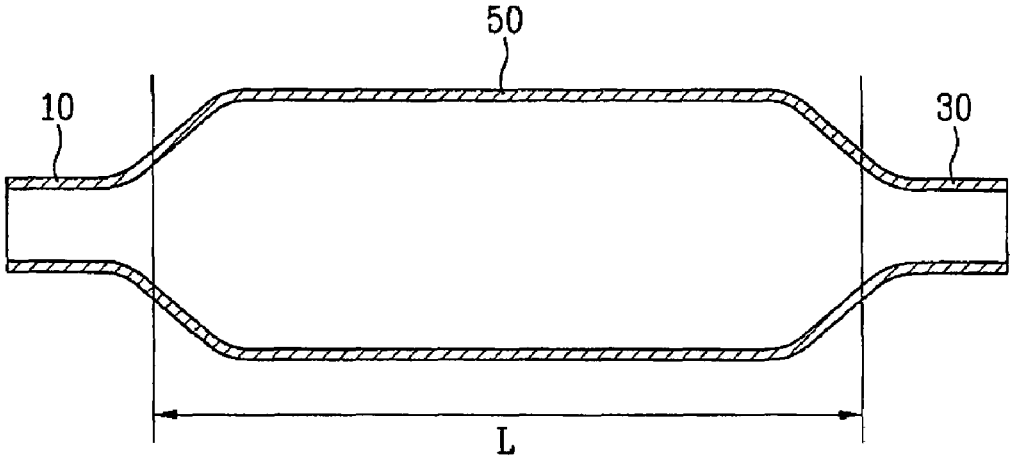
FIG. 1 is a sectional view illustrating a conventional silencer.
Figure 2:
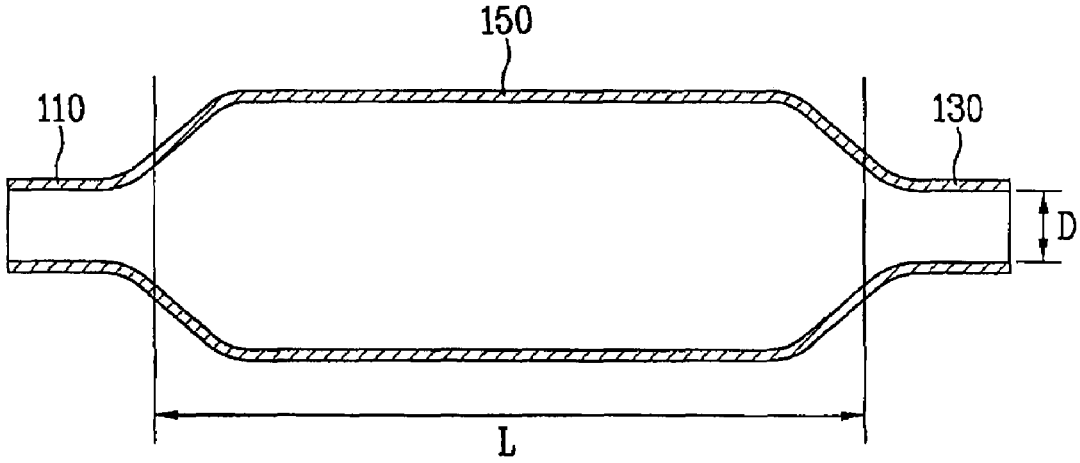
FIG. 2 is a sectional view illustrating a silencer according to a first embodiment of the present invention.

FIG. 2 is a sectional view illustrating a silencer according to a first embodiment of the present invention. Similarly to the conventional silencer, the silencer according to the present invention includes a first connection pipe 110 for guiding the flow of a fluid, a cylindrical expansion pipe 150 communicating with the first connection pipe 110 at one end thereof for guiding the flow of the fluid, the expansion pipe 150 having a sectional area greater than that of the first connection pipe 110, and a second cylindrical connection pipe 130 communicating with the other end of the expansion pipe 150 for guiding the flow of the fluid.

The first connection pipe 110, the expansion pipe 150, and the second connection pipe 130 are formed in the shape of a cylinder.

Figure 3:
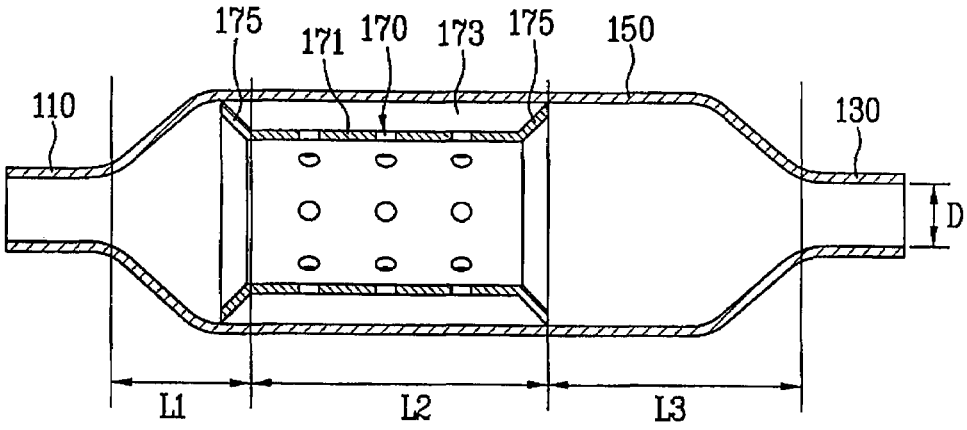
FIG. 3 is a sectional view illustrating a silencer according to a second embodiment of the present invention.

FIG. 3 is a sectional view illustrating a silencer according to a second embodiment of the present invention. This embodiment is characterized in that a silencing unit is mounted in the silencer shown in FIG. 2.

Specifically, the silencing unit is mounted in the expansion pipe 150 for removing noise from the expansion pipe 150. In this embodiment, the silencing unit is a resonance type silencing unit 170 for removing specific frequency noise using resonance. The silencing unit may be made of a sound absorbing material to absorb noise. In addition, the silencing unit may be constructed in other various forms.

The resonance type silencing unit 170 includes a perforation part 171 extending in the circumferential direction while being spaced a predetermined distance from the expansion pipe 150, the perforation part 171 having one or more through-holes, a resonance part 173 having a predetermined space defined between the inner wall of the expansion pipe 150 and the perforation part 171, and sidewall parts 175 disposed at opposite ends of the perforation part 171, respectively, the sidewall parts 175 being connected to the expansion pipe 150 such that the resonance part 173 constitutes a closed space.

The resonance type silencing unit 170 is an apparatus that reduces noise of a sound source having the same frequency as a resonance frequency decided by the volume of the resonance part 173, the size and number of the through-holes formed in the perforation part 171, and the physical properties of a fluid. Specifically, the resonance type silencing unit 170 uses the principle of a Helmholtz resonator. The silencer according to the present invention includes the resonance type silencing unit 170 with the above-stated construction, whereby it is possible to control noise depending upon the shape of the silencer, and, in addition, it is possible to further remove noise having the same frequency as the resonance frequency of the resonance type silencing unit 170.

Hereinafter, the design principle for noise removal of the silencers as shown in FIGS. 2 and 3 will be described in detail.

As previously described, the transmission loss (TL) of a general expansion type silencer is represented by Equation 1.

When the silencing unit is mounted in the expansion pipe 150, however, boundary conditions at the sidewall parts 175 are changed. Experiments revealed that the transmission loss (TL) is maximized in the following condition:

$$2kL = \frac{n\pi}{2},\ n = 1, 3, 5, \ldots \qquad \text{[Equation 4]}$$

The above equation may be expressed by the following equation:

$$k = \left(\frac{n\pi}{4}\right)\Big/ L,\ n = 1, 3, 5, \ldots \qquad \text{[Equation 5]}$$

On the other hand, a wave equation, which generally controls a wave motion, is represented by the following equation:

$$\nabla^2 p - \frac{1}{c^2}\frac{\partial^2 p}{\partial t^2} = 0 \qquad \text{[Equation 6]}$$

Where, p is sound pressure level, and c is sound speed.

On the other hand, the sound pressure level p, from which the time factor is separated in a cylindrical coordinate system, may be represented by the following equation:

$$p(r,\phi,z)=R(r)\Phi(\phi)Z(z) \qquad \text{[Equation 7]}$$

Where, R(r) is a radial component of the sound press level, $\Phi(\phi)$ is a circumferential component of the sound press level, and Z(z) is an axial component of the sound press level.

On the assumption that kr>>1, the R(r) may be expressed by the following equation:

$$R(r) = A2\sqrt{\frac{2}{\pi kr}\cos(kr - \pi/4)} \qquad \text{[Equation 8]}$$

In the condition of R(r)=O the radial mode satisfies the following equation:

$$kr - \pi/4 = \frac{m\pi}{2},\quad m = 1, 3, 5, \ldots \qquad \text{[Equation 9]}$$

The radius r is D/2, and therefore, Equation 9 may be expressed by the following equation:

$$k = \left(m\pi + \frac{1}{2}\pi\right)\Big/ D,\ \ m = 1, 3, 5, \ldots \qquad \text{[Equation 10]}$$

Finally, the connection between Equation 5 and Equation 10 satisfies the following equation:

$$L = \frac{n}{4m+2}D, \quad m, n = 1, 3, 5, \ldots \qquad \text{[Equation 11]}$$

Specifically, when the silencer is designed such that the length L of the expansion pipe and the diameter D of the connection pipe satisfies Equation 11, the radial mode condition at the connection pipes 110 and 130 connected to the expansion pipe 150 is satisfied while the noise reduction efficiency of the silencer is maintained.

The diameter D of the connection pipe may be the diameter D of the first connection pipe 110 or the second connection pipe 130. Preferably, however, the diameter D of the connection pipe is the diameter of the second connection pipe 130, whereby the reincrease of noise generated from a fluid having passed through the expansion pipe 150 due to the resonance of the second connection pipe 130 is effectively prevented.

On the other hand, when finding the simple relation between L and D while changing m and n as in Equation 11, L/D may be 1/2, 3/2, 5/2, 7/2 . . . . This relation may be represented by the following equation:

$$L = \left(l - \frac{1}{2}\right)D, \; l = 1, 2, 3, \ldots \qquad \text{[Equation 12]}$$

In the silencer shown in FIG. 2, the length L of the expansion pipe and the diameter D of the first and second connection pipes have a relation represented by Equation 11 according to the result of the above derived equation. Consequently, the attenuation condition of the silencer and the radial mode condition at the connection pipes are satisfied. It is preferable to design the silencer such that Equation 12, which is an equation simpler than other equations, is satisfied.

On the other hand, the resonance type silencing unit 170 is included in the silencer shown in FIG. 3. Consequently, the silencer is designed such that L1 and L3 satisfy Equation 11 or Equation 12. The length L2 of the resonance type silencing unit 170 is decided depending upon a specific frequency needed to be removed by the resonance type silencing unit 170. The resonance frequency of the resonance type silencing unit 170 is decided depending upon the length of the resonance type silencing unit 170, the size and the arrangement of the through-holes of the perforation part 171. Consequently, the silencer is designed by adjusting the above-specified factors based on a frequency at which a large amount of noise is actually generated.

As a result, specific frequency noise decided depending upon the length L of the expansion pipe 150 is removed, and, at the same time, the mode conditions of the first and second connection pipes 110 and 130 are satisfied in the L1 and L3 sections, whereby the resonance due to the first and second connection pipes 110 and 130 is effectively prevented, and noise corresponding to the target frequency is removed in the L2 section, i.e., the resonance type silencing unit 170.

Hereinafter, silencers according to third and fourth embodiments of the present invention will be described in detail with reference to FIGS. 4 and 5.

Figure 4:
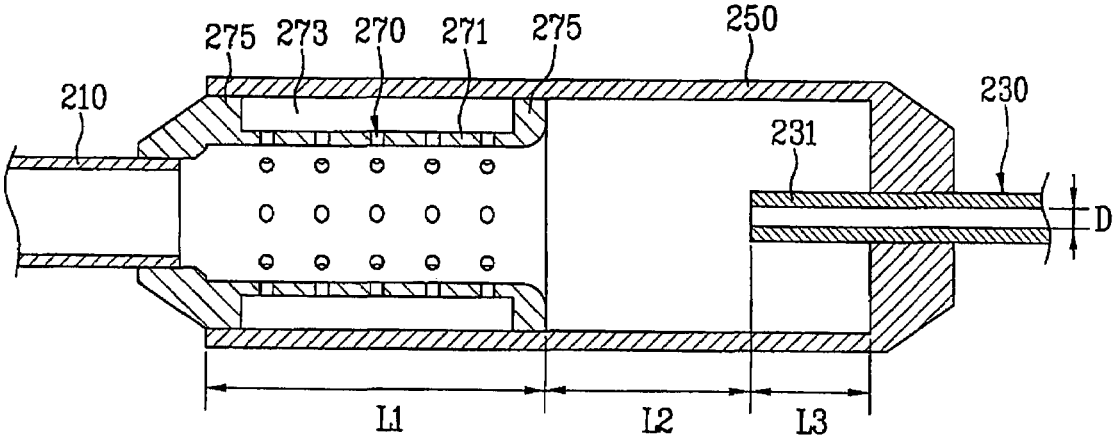
FIG. 4 is a sectional view illustrating a silencer according to a third embodiment of the present invention.

FIG. 4 illustrates a modification of the silencer shown in FIG. 3. As shown in FIG. 4, the silencer is constructed in a structure in which a resonance type silencing unit 270 is directly connected to a first connection pipe 210, and a second connection pipe 230 is fitted in an expansion pipe 250.

The second connection pipe 230 has an extension pipe 231 protruding toward the expansion pipe 250.

In the above-described structure, the length L2 of an empty space, in which no insertions are located, satisfies the following equation:

$$L2 = \frac{n}{4m+2}D, \quad m, n = 1, 3, 5, \ldots \qquad \text{[Equation 13]}$$

Equation 13 may be expressed by the following simplified equation:

$$L2 = \left(l - \frac{1}{2}\right)D, \; l = 1, 2, 3, \ldots \qquad \text{[Equation 14]}$$

Figure 5:
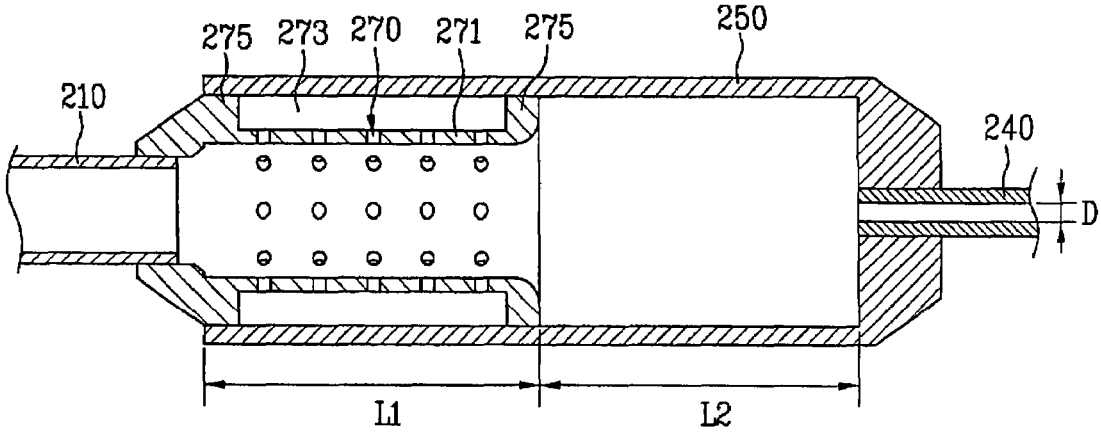
FIG. 5 is a sectional view illustrating a silencer according to a fourth embodiment of the present invention.

FIG. 5 illustrates a silencer constructed in a structure in which a second connection pipe 240 has no extension pipe unlike the silencer shown in FIG. 4.

Even in this structure, the silencer is designed such that the length L2 of an empty space, in which no insertion is located, satisfies Equation 13 and Equation 14.

Meanwhile, the silencers shown in FIGS. 4 and 5 are characterized in that the diameter of the first connection pipe is different from that of the second connection pipe. Preferably, therefore, the silencer is designed based on the diameter D of the second connection pipe such that the reincrease of noise generated from a fluid having passed through the silencer due to the resonance of the connection pipe is effectively prevented.

Hereinafter, silencers according to fifth and sixth embodiments of the present invention will be described in detail with reference to FIGS. 6 and 7.

Figure 6:
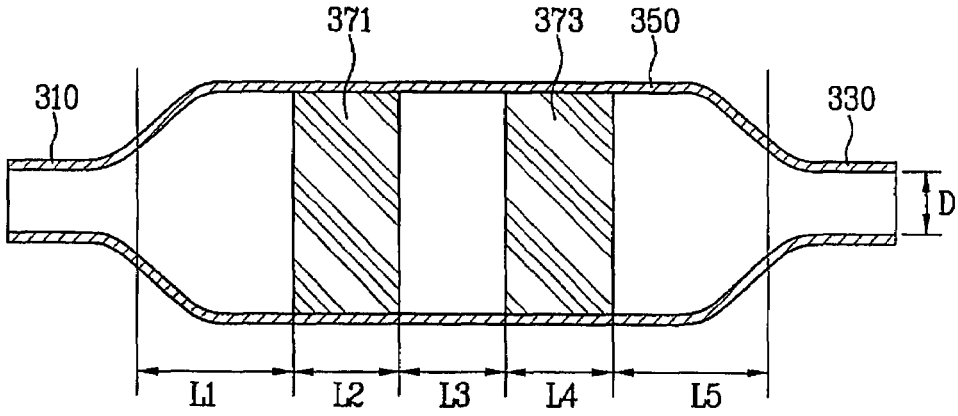
FIG. 6 is a sectional view illustrating a silencer according to a fifth embodiment of the present invention.
Figure 7:
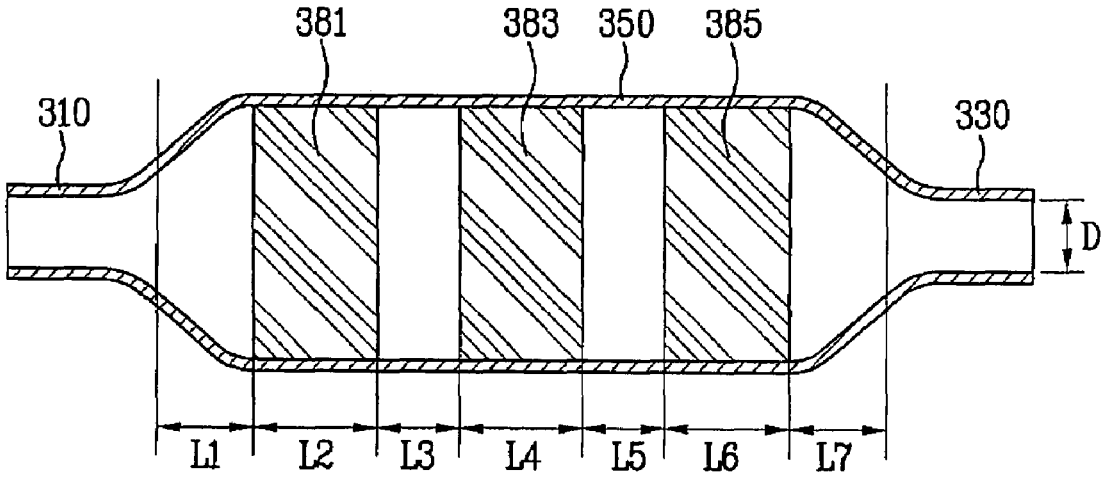
FIG. 7 is a sectional view illustrating a silencer according to a sixth embodiment of the present invention.

The silencers shown in FIGS. 6 and 7 each include a first connection pipe 310, an expansion pipe 350, and a second connection pipe 330. In the expansion pipe 350 are mounted insertions 371, 373; 381, 382, 385, such as silencing units.

Referring to FIG. 6, the insertions 371 and 383 may be silencing units, such as resonance type silencing units. In addition, the insertions 371 and 383 may be constructed in other various forms. Even in this case, the silencer is designed such that the lengths L1, L3, and L5 of empty sections, in which no insertions are located, satisfy Equation 11 and Equation 12.

On the other hand, the silencer shown in FIG. 7 is designed such that the lengths L1, L3, L5, and L7 of empty sections, in which no insertions are located, satisfy Equation 11 and Equation 12.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As apparent from the above description, the present invention has the following effects.

First, the length of the expansion pipe is optimized according to the diameter of a pipe connected to the silencer. Consequently, it is possible to prevent resonance caused by the pipe connected to the silencer, thereby improving the noise reduction efficiency of the silencer.

Secondly, when the silencing unit is mounted in the expansion pipe, the length of the expansion pipe is decided in consideration of the silencing unit. Consequently, it is possible to further reduce noise through the use of the silencing unit.

What is claimed is:

1. A silencer comprising:

a first connection pipe for guiding the flow of a fluid;

a expansion pipe communicating with the first connection pipe at one end thereof for guiding a flow of the fluid, the expansion pipe having a sectional area greater than that of the first connection pipe; and a second connection pipe communicating with another end of the expansion pipe for guiding flow of the fluid, wherein the expansion pipe has a length (L) decided depending upon a diameter (D) of the first connection pipe or the second connection pipe.

2. The silencer according to claim 1, wherein the diameter (D) of the first connection pipe or the second connection pipe and the length (L) of the expansion pipe satisfy the following equation:

$$L = \frac{n}{4m+2}D$$

Where, m and n are arbitrary odd numbers.

3. The silencer according to claim 1, wherein the diameter (D) of the first connection pipe or the second connection pipe and the length (L) of the expansion pipe satisfy the following equation:

$$L = \left(l - \frac{1}{2}\right)D$$

Where, l is an arbitrary positive number.

4. The silencer according to claim 1, further comprising:

a silencing unit mounted in the expansion pipe for removing noise.

5. A silencer comprising:

a first connection pipe for guiding a flow of a fluid;

a expansion pipe communicating with the first connection pipe at one end thereof for guiding flow of the fluid, the expansion pipe having a sectional area greater than that of the first connection pipe;

a second connection pipe communicating with another end of the expansion pipe for guiding flow of the fluid; and at least one silencing unit mounted in the expansion pipe for removing noise from the expansion pipe, wherein at least one length (L) of an opposite-end length between the first connection pipe and the at least one silencing unit and an opposite-end length between the at least one silencing unit and the second connection pipe is decided depending upon a diameter (D) of the first connection pipe or the second connection pipe.

6. The silencer according to claim 5, wherein the at least one length (L) of the opposite-end length between the first connection pipe and the at least one silencing unit and the opposite-end length between the at least one silencing unit and the second connection pipe satisfy the following equation:

$$L = \frac{n}{4m+2}D$$

Where, m and n are arbitrary odd numbers.

7. The silencer according to claim 5, wherein the diameter (D) of the first connection pipe or the second connection pipe and the at least one length (L) of the opposite-end length between the first connection pipe and the at least one silencing unit and the opposite-end length between the at least one silencing unit and the second connection pipe satisfy the following equation:

$$L = \left(l - \frac{1}{2}\right)D$$

Where, l is an arbitrary positive number.

8. The silencer according to claim 5, wherein the at least one silencing unit is a resonance type silencing unit which removes specific frequency noise using resonance.

9. The silencer according to claim 8, wherein the resonance type silencing unit comprises:

a perforation part extending in a circumferential direction while being spaced a predetermined distance from the expansion pipe, the perforation part having one or more through-holes;

a resonance part having a predetermined space defined between an inner wall of the expansion pipe and the perforation part; and sidewall parts disposed at opposite ends of the perforation part, respectively, the sidewall parts being connected to the expansion pipe such that the resonance part constitutes a closed space.

10. The silencer according to claim 5, wherein:

the at least one silencing unit comprises a plurality of silencing units mounted in the expansion pipe such that the silencing units are spaced a predetermined distance from each other; and the diameter (D) of the first connection pipe or the second connection pipe and a distance (L) between the respective silencing units satisfy the following equation:

$$L = \frac{n}{4m+2}D$$

Where, m and n are arbitrary odd numbers.

11. The silencer according to claim 10, wherein the diameter (D) of the first connection pipe or the second connection pipe and the distance (L) between the respective silencing units satisfy the following equation:

$$L = \left(l - \frac{1}{2}\right)D$$

Where, l is an arbitrary positive number.

12. The silencer of claim 1, wherein the fluid is a gas.

13. The silencer of claim 1, wherein the length (L) of the expansion pipe is based on the diameter (D) of the second connection pipe and wherein the fluid flows in a direction from the first connection pipe to the second connection pipe through the expansion pipe.

14. The silencer of claim 13, wherein a ratio of the length of the expansion pipe to the diameter of the second connection pipe (L/D) prevents a predetermined type of noise from increasing as the fluid passes from the expansion pipe to the second connection pipe, said predetermined type of noise corresponding to noise generated as a result of resonance of the second connection pipe.

15. The silencer of claim 1, further comprising:

a silencing unit located in a first section of the expansion pipe and including:

a first member including a plurality of holes that are aligned in a first direction different from a second direction in which the fluid flows, one or more second members that extend between the first member and an inner wall of the expansion pipe to form at least one enclosed space, wherein at least a portion of the holes in the first member open into the enclosed space and wherein a frequency of noise reduced in the expansion part is based on a volume of the enclosed space.

16. The silencer of claim 15, wherein the silencing unit reduces said frequency of noise based on a Helmholtz resonating principle.

17. The silencer of claim 15, wherein the silencing unit is located between second and third sections of the expansion pipe, and wherein each length of the second and third sections satisfies at least one of the following equations:

$$L = \frac{n}{4m+2}D$$

where m and n are arbitrary odd numbers, or $$L = \left(l - \frac{1}{2}\right)D$$

where l is an arbitrary positive number.

18. The silencer of claim 17, wherein a length of the first section of the expansion pipe is based on the frequency of noise to be reduced.

19. The silencer of claim 15, wherein the one or more second members extend towards the inner wall of the expansion pipe at one or more predetermined angles, said one or more predetermined angles being different from right angles relative to the inner wall.

20. The silencer of claim 15, wherein the one or more second members extend towards the inner wall of the expansion pipe at substantially right angles relative to the inner wall.

21. The silencer of claim 15, wherein the expansion pipe includes first, second, and third sections, wherein the first section includes the silencing unit and the second and third sections are located either before or after the first section, and wherein the third section includes an extension pipe in alignment with the silencing unit in the first section and coupled to the second connection pipe.

22. The silencer of claim 21, wherein the second section is between the first and third sections and wherein the second section is an empty space.

23. The silencer of claim 22, wherein a length of the second section is based on the following equation:

$$L2 = \frac{n}{4m+2}D,$$

where n and m are odd numbers.

24. The silencer of claim 22, wherein a length of the second section is based on the following equation:

$$L2 = \left(l - \frac{l}{2}\right)D,$$

where l is a positive number.

25. The silencer of claim 22, wherein a length of the third section corresponds to a length to which the extension pipe projects into the expansion pipe.

26. The silencer of claim 22, wherein a diameter of the extension pipe is different from a diameter of the first connection pipe.

27. The silencer of claim 15, wherein the expansion pipe includes first and second sections, wherein the first section includes the silencing unit and the second section is an empty space, and wherein a length of the second section is one of the following equations:

$$L2 = \frac{n}{4m+2}D,$$

where n and m are odd numbers, or $$L2 = \left(l - \frac{l}{2}\right) - D,$$

where l is a positive number.

28. The silencer of claim 27, wherein a diameter the second connection pipe is different from a diameter of the first connection pipe.

29. The silencer of claim 15, further comprising:

another silencing unit within the expansion pipe, wherein the silencing units are separated by at least one section containing an empty space.

30. The silencer of claim 1, wherein the first connection pipe and the second connection pipe have different diameters.

31. The silencer of claim 1, wherein the first and second connection pipes are cylindrical pipes.

* * * * *